US008020941B2

(12) United States Patent
Latham

(10) Patent No.: US 8,020,941 B2
(45) Date of Patent: Sep. 20, 2011

(54) CUTTER BIT INSERT REMOVAL SYSTEM AND METHOD

(75) Inventor: Winchester E. Latham, Avon, IN (US)

(73) Assignee: Keystone Engineering & Manufacturing Corporation, Avon, IN (US)

( * ) Notice: Subject to any disclaimer, the term of this patent is extended or adjusted under 35 U.S.C. 154(b) by 288 days.

(21) Appl. No.: 12/332,769

(22) Filed: Dec. 11, 2008

(65) Prior Publication Data

US 2010/0148568 A1 Jun. 17, 2010

(51) Int. Cl.
*E21C 35/197* (2006.01)

(52) U.S. Cl. ..... 299/104; 299/103; 299/111; 29/426.5

(58) Field of Classification Search ..... 299/100–113; 29/426.5, 863

See application file for complete search history.

(56) References Cited

U.S. PATENT DOCUMENTS

| | | | | |
|---|---|---|---|---|
| 5,842,747 | A | 12/1998 | Winchester | 299/87.1 |
| 6,086,160 | A | 7/2000 | Bitelli | 299/104 |
| 6,331,035 | B1 | 12/2001 | Montgomery, Jr. | 299/106 |
| 6,364,420 | B1 | 4/2002 | Sollami | 299/106 |
| 6,692,083 | B2 | 2/2004 | Latham | 299/104 |
| 6,764,140 | B2 | 7/2004 | Carson, Jr. et al. | 299/79.1 |
| 6,779,850 | B1 | 8/2004 | Schibeci et al. | 299/87.1 |
| 6,832,818 | B2 | 12/2004 | Luciano | 299/39.8 |
| 6,863,352 | B2 * | 3/2005 | Sollami | 299/107 |
| 7,380,887 | B2 | 6/2008 | Latham | 299/87.1 |
| 7,410,221 | B2 | 8/2008 | Hall et al. | 299/107 |
| 7,832,808 | B2 * | 11/2010 | Hall et al. | 299/104 |

* cited by examiner

*Primary Examiner* — John Kreck
*Assistant Examiner* — Yong-Suk Ro
(74) *Attorney, Agent, or Firm* — Brinks Hofer Gilson & Lione

(57) ABSTRACT

A system and method to remove quickly an insert, especially an insert with a damaged gripping portion, from a base portion of a mining and/or milling drum. The insert can have a threaded portion engageable with the base portion opening. The insert can define an interior bore configured to receive a cutter bit, and an opening configured to receive an apparatus engageable with the insert opening to facilitate the removal of the insert from the base portion. The insert opening may be polygonal or may include at least one planar surface and/or a rounded corner. An apparatus can engage with the polygonal opening and/or a fastener can engage with the shafted fastener. In both cases, the apparatus and/or fastener is rotated with a force to disengage the threaded portion of the insert from the opening of the base portion.

20 Claims, 7 Drawing Sheets

CUTTER BIT INSERT REMOVAL SYSTEM AND METHOD

BACKGROUND

1. Field of the Invention

This invention generally relates to the field of rotary driven cylindrical cutter devices and scarifiers for use in roadway surface reclaiming, earthworking, mining, or other in situ disintegration of hard materials. More particularly, the present invention is directed to cutter bit inserts for such rotary driven cylindrical cutter devices and scarifiers and the removal of such cutter bit inserts.

2. Background of the Invention

In general, roadway surface milling, planing, or reclaiming equipment disclosed in the prior art includes a rotary driven cylindrical comminuting drum which acts to scarify and to mine the top portion of the asphaltic road surface in situ. Another application using a rotary driven cylindrical comminuting drum is coal mining. Coal mining machines with shearing drums are used rather widely in mining, particularly in underground mining of bituminous coal. Regardless of the application, the rotary driven drum may include flighting on the drum which acts to collect the mined or milled material or rubble toward the center of the drum where the material can be removed. In roadway surface milling, the rubble is then remixed with additional bituminous material and thereafter redeposited as a newly formed smooth asphaltic surface. In coal mining, the loosened coal rubble is collected onto a pan line, taking the coal to the conveyor belt for removal from the work area to the surface where the rubble is further processed.

In some prior art devices of this type, a plurality of cutter bit support members are connected to the curved surface of the drum or to the flighting by bolts or by weld. The plurality of the support members may be arranged end-to-end so as to form a substantially continuous helical pattern. The top surface of the helically arranged support members may be elevated above the curved surface of the drum. The top surfaces include angled openings into which conventional cutter bits are received. The cutter bits are generally a conical cutter with preferably a tungsten carbide tip or the like. Optionally, the support member may include an opening for receiving cutter bit insert that is removably mounted to the support member, for instance by threaded attachment. The insert has an opening for receiving the cutter bit and a gripping surface used for inserting and removing the cutter bit inserts with respect to the support members.

One example of a cutter bit insert is disclosed in U.S. Pat. No. 5,842,747 to Latham. Here, the insert includes a gripping surface, a conical shoulder, and a lower surface, defines an interior bore for receiving a cutter bit, and has external threads capable of threaded engagement with threads of a base portion. The gripping surface allows for easy access for removal of inserts. Threaded jamming fastener is also disposed in threaded engagement with threads of the base portion. The jamming fastener is initially positioned below the insert by use of an appropriate tool in the jamming fastener opening. After the insert is in place, the appropriate tool again is inserted in the jamming fastener opening and rotated to translate the jamming fastener toward the lower end of the insert until contact. Accordingly, the reverse is true when removing such insert from the base portion, especially when the insert is damaged. However, when the gripping surface of the insert is damaged, it becomes difficult to remove the insert for replacement.

Damage to the inserts can be common. During use, abrasive forces, which often include rather substantial extreme sudden shocks, are transmitted to the cutter bits. Oftentimes, the forces are unevenly distributed between the cutter bits and inserts, which causes the cutter bits to vibrate and otherwise move and rotate within the support member opening or within the insert. Particularly in the presence of abrasive dust from the roadway surface reclaiming operation and the mining operation, the vibration and movement of the cutter bits act to enlarge the openings to such an extent that the cutter bits can be thrown out of the inserts. Indeed, depending on the abrasiveness of the mining surface, cutter bits and inserts can become damaged after about 4 hours to about 1 week of operation. It is desirable for the less expensive cutter bit to become damaged before the more expensive insert and even the more expensive and difficult to replace support member, in order to extend the life of the insert and the support member.

Unfortunately, the short life of cutter bits and/or inserts causes the mining machine to be stopped frequently for considerable lengths of time for repairs. In particular, repair and replacement of the insert damaged in this manner typically necessitates the use of an easy-out or similar removing tool in the field to remove the insert. Typically as a last resort, it becomes necessary to remove the support member portions, usually with the aid of a cutting torch, and to weld new support member portions in place. This is a time-consuming repair job which results in considerable expense to a mining machine operation, and results in a decreased rate in mining.

Despite the availability of such devices, there exists a need in the art for an apparatus and system having an insert for a roadway surface reclaiming drum that is capable of removable attachment to a base portion, yet is resistant to loosening upon rotation of the drum. There is also a need for the optimal removal of an insert, and in particular, an insert with a damaged gripping surface, in order to decrease the time and costs of repair and replacement.

SUMMARY

An apparatus for use on a cylindrical surface portion of a mining or milling drum adapted to be rotated in a cutting direction about a cylindrical axis defined by the drum is provided for the present invention. More specifically, in one aspect, the apparatus includes a base portion adapted to be mounted to a cylindrical surface portion of a drum and defining a tapped opening. The apparatus also includes a cutter bit insert having a first end and a second end and defining an interior bore configured to receive at least one cutter bit. The insert can include a threaded portion threadably engageable with the tapped opening of the base portion. The interior bore can have a first end positioned proximate the first end of the insert and a second end terminated at a portion between the first and second ends of the insert. The insert may also include an opening having a first end contacting the second end of the interior bore and a second end disposed proximate the second end of the insert. The opening is configured to receive an apparatus engageable with said opening to facilitate the removal of the insert from the base portion, especially when the gripping surface of the insert is damaged to a degree where the gripping surface can no longer be used in the removal process of the damaged insert. In other words, the insert provides an alternative means to remove the insert. In some examples, the opening may include at least one planar surface and at least one rounded corner. Preferably, the opening includes four planar surfaces interconnected by rounded corners.

In a second aspect, the insert includes an opening having a polygonal shape. The polygonal opening can have a first end contacting the interior bore second end and a second end terminated at the second end of the insert. The polygonal opening can have a cross-sectional area selected from a group consisting of: rectangular, pentagonal, hexagonal, octagonal, and spline. Other examples of the opening may include a first portion and a second portion, the first portion having a hexagonal shape. The second portion may have a shape with four planar surfaces interconnected by rounded corners In another embodiment, a system for removing an insert from a base portion mounted on a portion of a milling or mining drum is provided. The system is particularly useful when the gripping surface of the top portion of the insert is damaged beyond usability. Besides the described base portion and the insert described above, the system includes an apparatus configured to engage with said opening to facilitate the removal of the insert from the base portion when the insert and the base portion are threadably engaged. In one example, the opening of the insert has a shape with at least one planar surface and at least one rounded corner. The apparatus can include a fastener having a similar shape as the opening and a threaded portion. The interior bore and the opening can be in communication to define a pathway, where the pathway is sized to receive a shafted fastener having a threaded portion threadably engageable with the threaded portion of the fastener. In another example, the opening of the insert can have a hexagonal shape, and the apparatus can include a tool having a similar shape as the opening, such as an Allen wrench.

In another embodiment, a method of removing an insert from a base portion mounted on a portion of a drum for use with a mining or milling machine is provided. The base portion can have a tapped opening. The insert is threadably engaged with the tapped opening of said base portion. The apparatus can be securably engaged with the opening of the insert, with the apparatus configured to be engageable with the opening to facilitate the removal of the insert from the base portion. The apparatus can be rotated with sufficient force to disengage the threaded portion of the insert from the tapped opening of said base portion to remove the insert from the base portion. In one example, the apparatus is a fastener configured to engage with the opening and includes a threaded portion. The method can further include the step of inserting a shafted fastener through the opening of the insert to threadably engage with the threaded portion of the fastener. In another example, the opening can have a multi-sided shape selected from a group consisting of: rectangular, pentagonal, hexagonal, octagonal, and spline. The apparatus is frictionally engageable with the opening, with the apparatus having a body including a similar shape as the opening.

The above, as well as other advantages of the present invention, will become readily apparent to those skilled in the art from the following detailed description of a preferred embodiment when considered in the light of the accompanying drawings.

DESCRIPTION OF PREFERRED EMBODIMENTS

Figure 1:
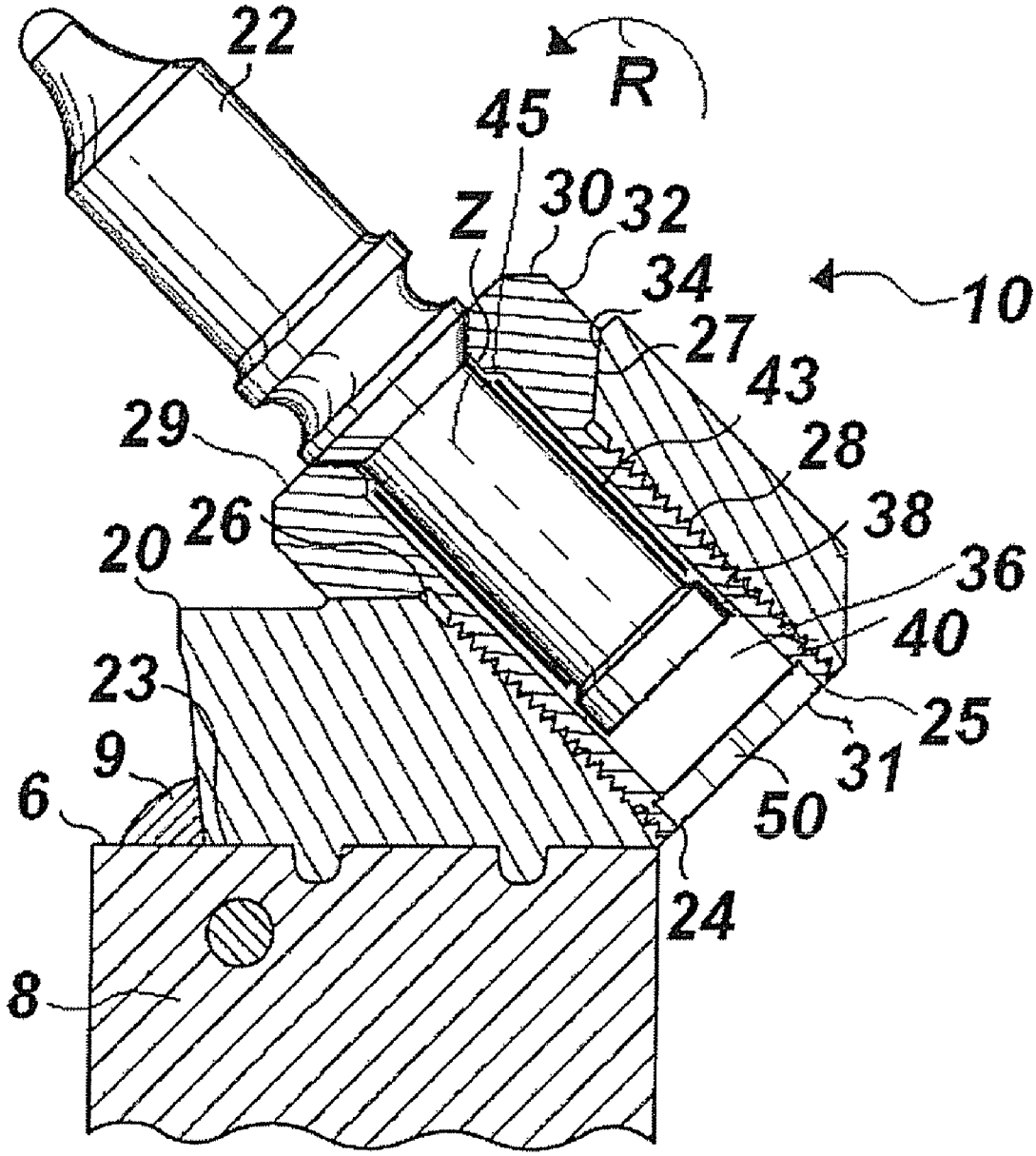
FIG. 1 is an enlarged, partial section view of a base portion, a cutter bit insert, and a portion of a roadway surface reclaiming drum representing the present invention, depicted with a cutter bit.

With reference to all the Figures where reference numerals are generally used to identify like components, FIG. 1 illustrates an apparatus 10 for use on a portion of a cylindrical surface of a milling or mining drum, adapted to be rotated in a cutting direction R about a cylindrical axis defined by the drum. Optionally, the apparatus 10 can be used on flighting that is attached to the portion of the cylindrical surface portion of the drum. A base portion 20 can be mounted to the surface of the drum or to the flighting, for instance by bolting or welding. The base portion 20 can include at a cutter bit 22 at the radially outward extremity of the base portion 20. The cutter bit 22 can be cylindrically shaped with a conical tip, typically carbide-tipped, which is directed forward in the direction R. Cutter bits 22 can forcibly contact a surface to be mined or milled and, in a known manner, mine, mill, or reclaim a controlled portion of such surface. As a result, this can leave such surface substantially planar with a slightly roughened surface texture.

The base portion 20 includes a mounting surface 23 and a slanted surface 24. The base portion 20 is mounted to a radially outermost portion 6 of the portion 8 of the drum or flighting sections, for instance by base portion welds 9 as shown in FIG. 1, so that the mounting surface 23 is adjacent to the radially outermost portion 6. Side welds can attach together adjacent base portions 20 and, in addition, help prevent loosened roadway material from moving between adjacent base portions 20. The base portion 20 defines a tapped opening 26 aligned with a longitudinal axis Z and is adapted to receive a cutter bit insert 30. The opening 26 of the base portion 20 can include a lower end 25, a conical seat 27, and a threaded portion 28.

Figure 2A:
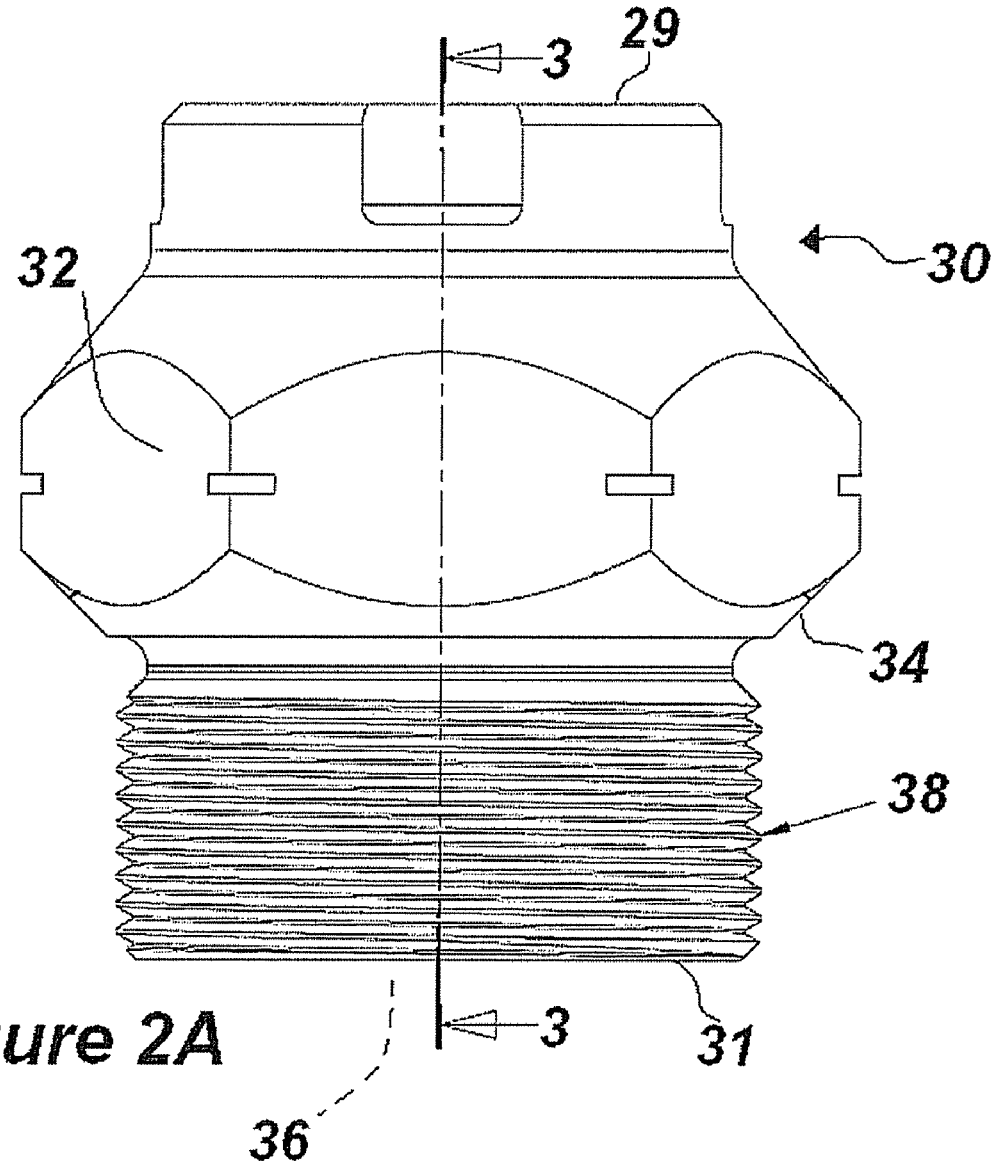
FIG. 2A is a side view of an insert.

Referring to FIGS. 1 and 2A, the insert 30 can include a gripping surface 32, a conical shoulder 34, a first end 29 that is positioned away from the radially outermost portion 6, and a second end 31 positioned proximate the radially outermost portion 6. The insert 30 defines an interior bore 36 configured to receive the cutter bit 22 and has a threaded portion 38 capable of threaded engagement with the threads 28 of the base portion 20. The insert 30 can be threadably engaged with the base portion 20, with the conical shoulder 34 of the insert 30 disposed in wedged frictional contact against the conical seat 27 of the base portion 20. As a result, this aids in securing the insert 30 to the base portion 20 and keeping the threaded portion 38 from being under shock load during the cutting operation. The gripping surface 32 can allow easy access for removal of the insert 30. The insert 30 can be formed of hardened material, such as hardened steel or the like, since the insert is not welded.

Figure 2B:
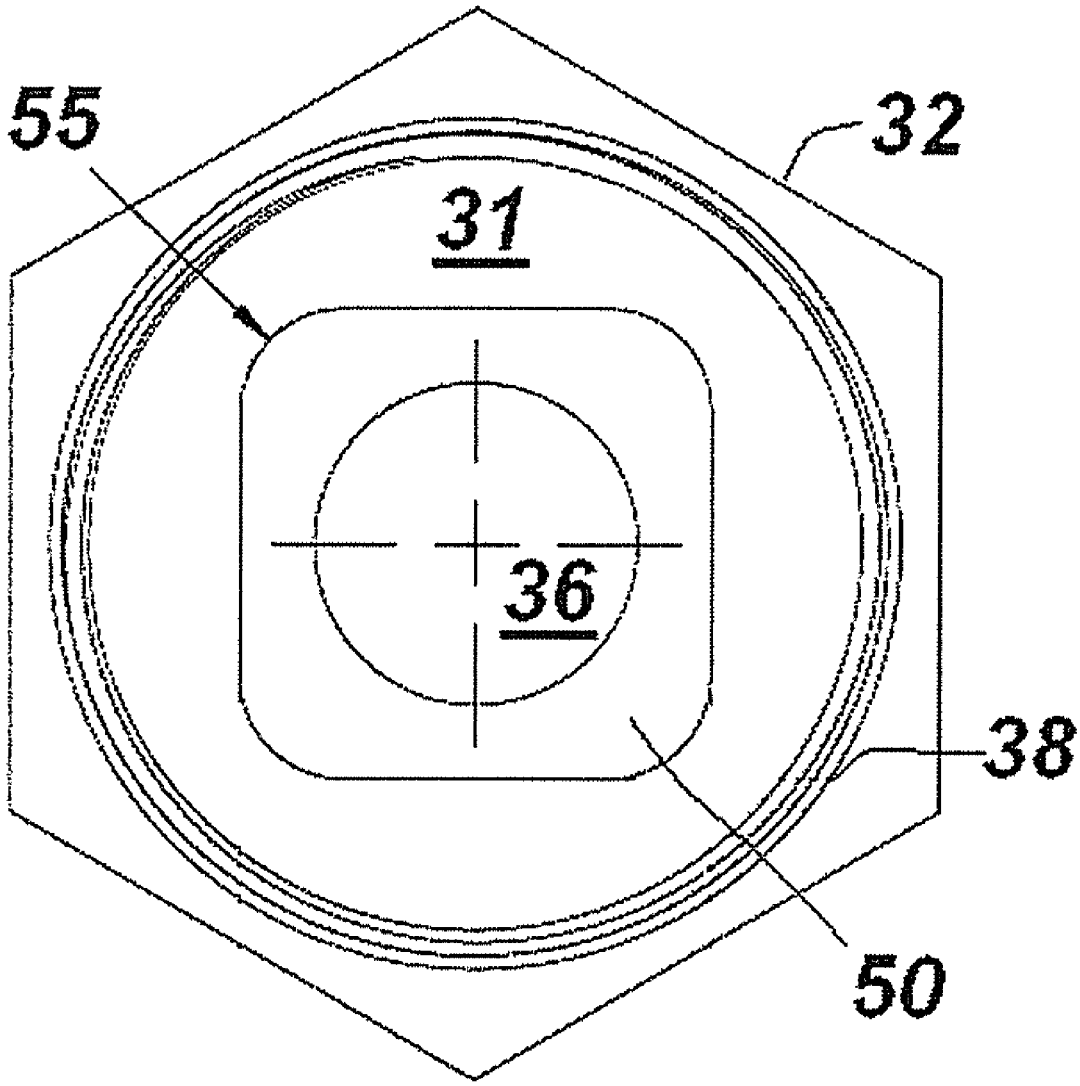
FIG. 2B is a bottom view of the cutter bit insert of FIG. 2A.
Figure 2C:
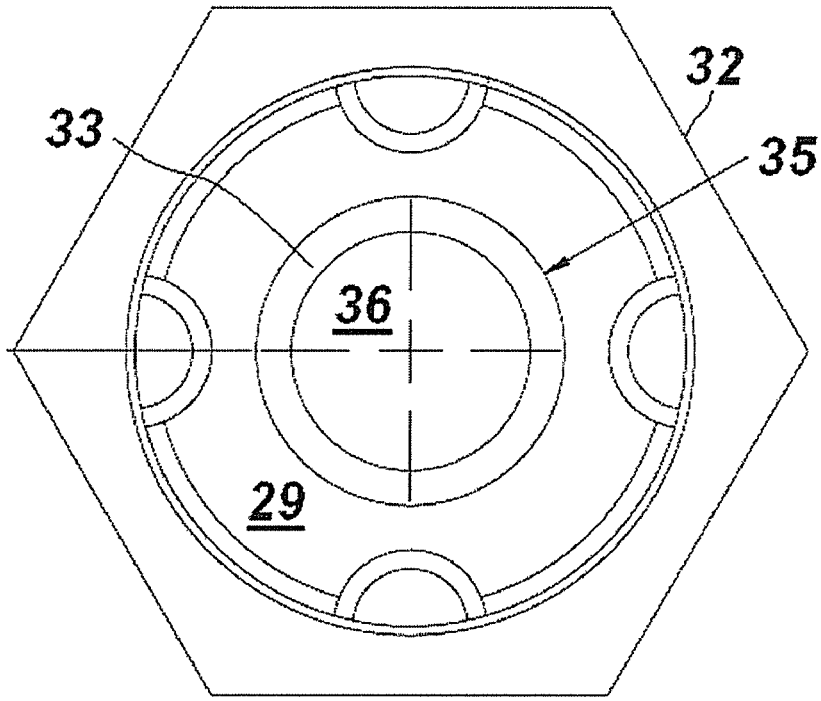
FIG. 2C is a top view of the cutter bit insert of FIG. 2A.
Figure 3:
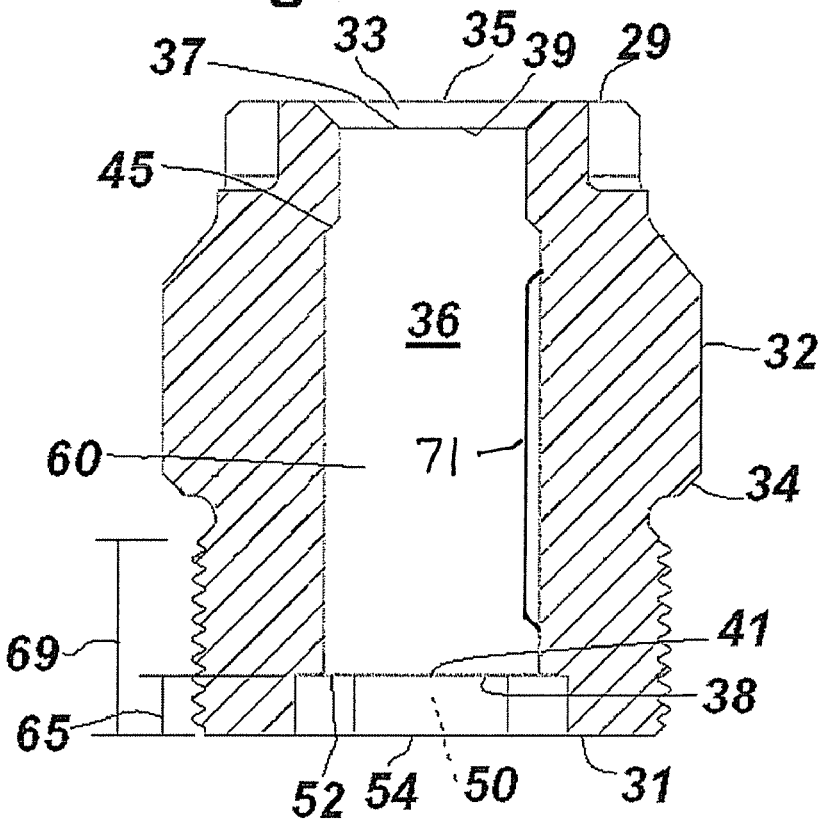
FIG. 3 is a cross-sectional view taken along line 3-3 of the insert of FIG. 2A.

FIG. 3 is a cross-sectional view taken along line 3-3 of the insert 30 of FIG. 2A. As illustrated in FIGS. 2A and 3, the interior bore 36 can have a first end 39 positioned proximate the first end 29 of the insert 30 and a second end 41 that terminates within the insert 30. FIG. 2C illustrates a top view of the insert in FIG. 2A. The first end 39 of the interior bore 36 is for removably receiving the cutter bit 22. The threaded portion 38 and the interior bore 36 of insert 30 can be disposed substantially coaxially. The interior bore 36 can also include an entry opening 33. The entry opening 33 preferably is a conical opening having a first end 35 with a circular cross-sectional area greater than a circular cross-sectional area of a second end 37 of the entry opening 33. The interior bore 36 preferably has a circular cross-sectional area. More preferably, the interior bore 36 has a circular cross-sectional area that is substantially the same as the cross-sectional area of the second end 37 of the entry opening 33.

An expandable cylindrical sleeve 43 can also be provided to frictionally engage the cutter bit 22 with the insert 30, as shown in FIG. 1. The expandable cylindrical sleeve 43 can prevent the cutter bit 22 from translating within the interior bore 36 of the insert 30. The expandable sleeve 43 is attached around a shank portion of the cutter bit 22, with the expandable sleeve 43 being normally in an expanded state. The cutter bit 22 with the expandable sleeve 43 can be forcibly inserted into the interior bore 36, which causes the expandable sleeve 43 to move between the expanded state and a compressed state to frictionally engage the cutter bit 22 and the surface of the interior bore 36. The combined cross-sectional area of the shank of the cutter bit 22 and the expandable sleeve 43 should be slightly less than the cross-sectional area of the interior bore 36 to ensure securable engagement within the interior bore 36. In some embodiments, the interior bore 36 can also include a key or other protrusion 71 as shown, for example, in FIGS. 3 and 5A. The protrusion 71 can engage a nipple, raised portion, or longitudinal edge of the spring sleeve 43 to further inhibit rotation of the sleeve 43 relative to the bore 36.

In some embodiments, the interior bore 36 may have an internal flange 45 with a reduced cross-sectional area as compared to a substantial portion of the interior bore 36. FIG. 1 illustrates the internal flange 45 having a cross-sectional area slightly less than the cross-sectional area of the cutter bit 22 in order to reduce the likelihood of abrasive dust entering into the interior bore 36 and to further secure the expandable sleeve 43 within the interior bore 36. Although the lower portion of the edge of the internal flange 45 is shown in FIG. 1 to be a chamfered edge to facilitate the removal of the expandable sleeve 43, the lower portion of the internal flange 45 can be square or perpendicular. The chamfered edge can urge the expandable sleeve 43 to radially compress to the compressed state, i.e., a cross-sectional area that is small enough to permit withdrawal. The angle of the chamfered edge can be about 30 degrees to about 60 degrees; however, it can be appreciated by one skilled in the art that the angle can be any degree suitable to retain the expandable sleeve 43 in one aspect, and to urge the expandable sleeve 43 to the compressed state in another aspect. In other embodiments, the cross-sectional area of the interior bore 36 can be substantially the same throughout, and a step ring can be attached, preferably by brazing or welding, at a region near the first end 39 of the interior bore 36. The step ring has an outer edge with a cross-sectional area substantially similar to the cross-sectional area of the interior bore 36 and an inner edge with a cross-sectional area that is less than the cross-sectional area of the outer edge. The material of the step ring can made of metal known in the art, and preferably, hardened steel. The step ring can perform the same function, and can also have the chamfered edge, similar to the internal flange 45 described above.

The insert 30 can also include an end opening 50 configured to engage a fastener 56. The end opening 50 can have a first end 52 contacting the second end 41 of the interior bore and a second end 54 positioned at the second end 31 of the insert 30. The end opening 50 can have a cross-sectional area that is square, rectangular, hexagonal, or any other shape known in the art. FIG. 2B is a bottom view of the insert 30 of FIG. 2A illustrating one preferred embodiment of the end opening 50 having a general square shape with rounded corners 55. The rounded corners 55 can permit the fastener 56 to engage and/or disengage from the end opening 50 much easier after use. The end opening 50 can have a cross-sectional area that is greater than the cross-sectional area of the interior bore 36. Optionally, the end opening 50 can have a cross-sectional area that is less than the cross-sectional area of the interior bore 36.

Figure 4:
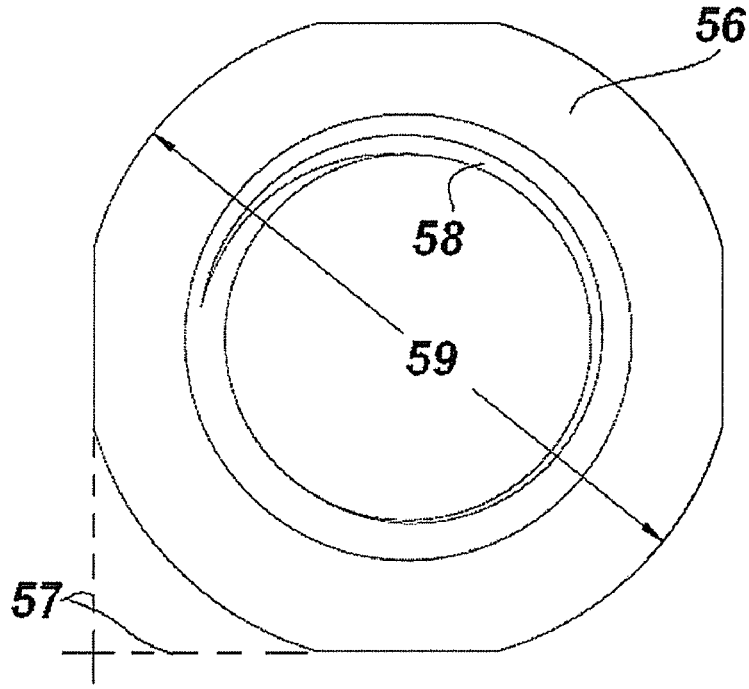
FIG. 4 is a top view of a fastener.

The fastener 56 is sized and structurally arranged to engage within the end opening 50. The fastener 56 can have a substantially similar cross-sectional area and shape as the end opening 50 such that the fastener 56 slides and snugly fits within the end opening 50. For example, FIG. 4 illustrates the fastener 56 having a square shape with rounded corners 59. The rounded corners 59 can have a radius of curvature larger than the radius of curvature of the rounded corners 55 of the end opening 50. The fastener 56 can have a threaded portion 58 that threadably engages with a shafted fastener 62. The fastener 56 can be made of a square stock (shown with dashed lines 57) with machined rounded corners 59 or a circular stock with machined planar surfaces. A portion of the fastener can extend past the second end 31 of the insert 30 such that an appropriately sized and shaped tool can securably engage with that portion during the removal process.

Figure 5A:
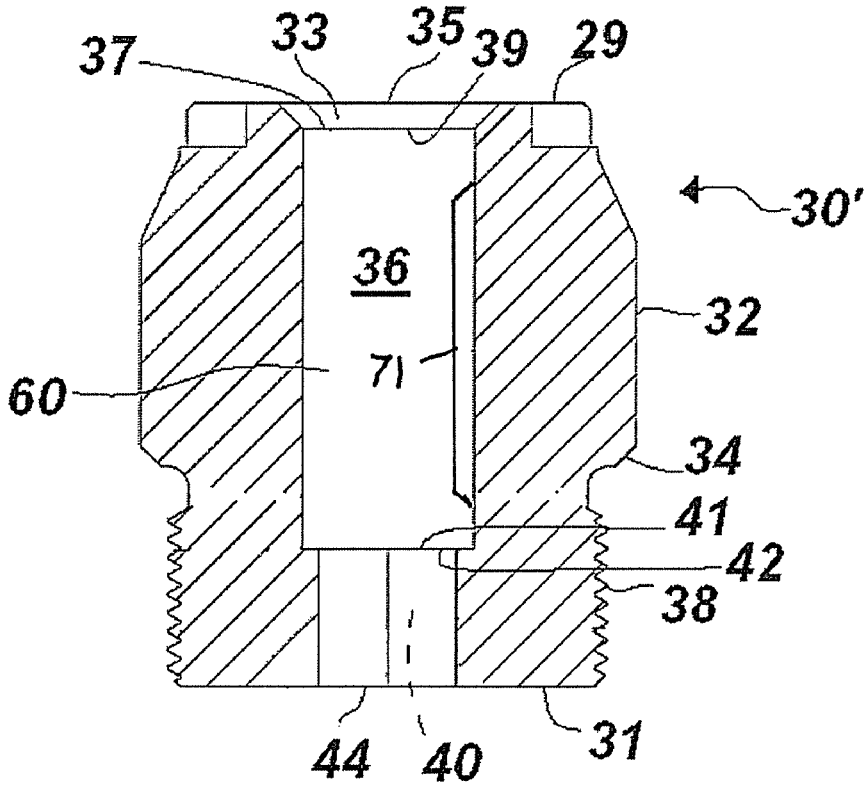
FIG. 5A is a cross-sectional view of another insert having a polygonal opening.
Figure 5B:
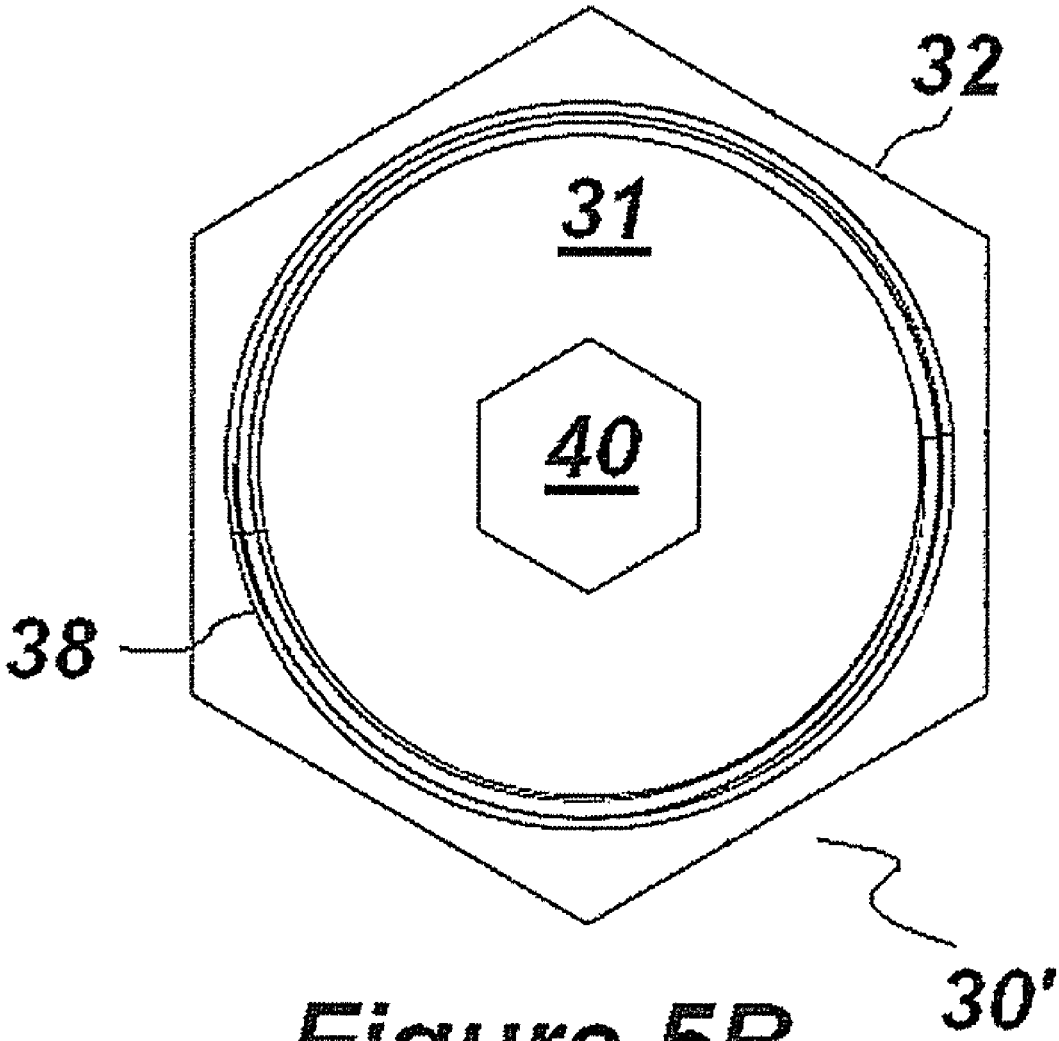
FIG. 5B is a bottom end view of the cutter bit insert of FIG. 5A.

In another embodiment illustrated in FIG. 5A, the insert 30' can include a polygonal opening 40 having a first end 42 contacting the interior bore second end 41 and a second end 44 proximate the second end 31 of the insert 30'. The polygonal opening 40 can be machined or manufactured with a broach having the shape of square, rectangular, hexagonal, octagonal, or any polygonal shaped broach. Optionally, the polygonal opening 40 can be shaped as a spline or other star-like shape. FIG. 5B is a bottom view of the insert 30' of FIG. 5A illustrating one preferred embodiment of the polygonal opening 40 having a general hexagonal shape. The broach used for the polygonal opening 40 can be designed for sharp or rounded corners, and can be machined or manufactured in either push or pull type designs. Preferably, the polygonal opening 40 has a cross-sectional area that is less than the cross-sectional area of the interior bore 36, although the cross-sectional area could be larger than that of the interior bore 36. The polygonal opening 40 is preferably shaped and sized to fit standard tools, such as an Allen wrench or Torx wrench. Some embodiments may include both the polygonal opening 40 and the end opening 50 to add another feature for quickly changing out the insert.

Referring to FIGS. 3 and 5A, the interior bore 36 and the end opening 50 and/or the polygonal opening 40 are in communication throughout the insert 30 to define a pathway 60. Preferably, a portion 69 representing the length of the threaded portion 38 is greater than the length of a portion 65 of the pathway 60 of insert 30 including the end opening 50 and/or the polygonal opening 40. Alternatively, the portion 69 of the threaded portion 38 can be less than the portion 65 of the pathway 60. The pathway 60 can be sized to receive the shafted fastener 62, with the shafted fastener 62 having threaded portion 64 capable of threaded engagement with the threaded portion 58 of the fastener 56. The threaded portion 64 can be threaded in opposite direction in relation to the threaded portion 38 of the insert 30, making the disengagement of the insert 30 from the base portion 20 easier.

Figure 6:
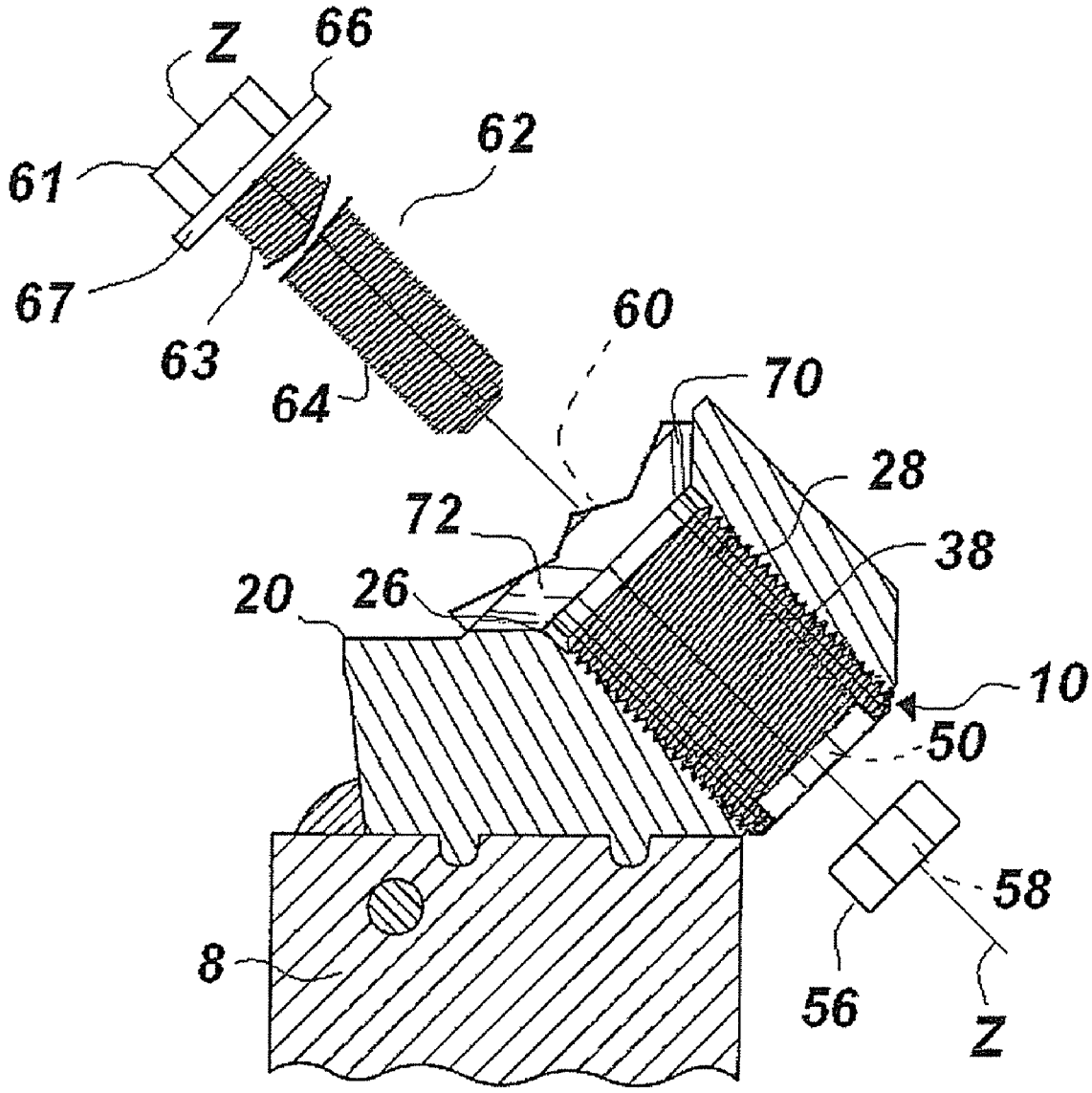
FIG. 6 is a side view of a base portion and an insert having a damaged gripping surface, depicted with a shafted fastener and a fastener of one embodiment of the present invention.

FIG. 6 illustrates the shafted fastener 62 preferably being a bolt having a hexagonal head 61 and a shank 63. However, the cross-sectional area of the head 61 of the shafted fastener 62 can be square, rectangular, hexagonal, or any shape known in the art. A washer 66 can also be included with the shafted fastener 62. The washer 66 can have a cross-sectional area along a perimeter 67 that is greater than the cross-sectional area of the interior bore 36. Preferably, the washer 66 has a circular cross-section at the perimeter 67 and an interior edge defining a circular interior opening that is sized to receive the shafted fastener 62.

With reference generally to all the Figures, and in particular FIG. 6, a method of removing the insert 30 from the base portion is provided. Damage to inserts 30, and particularly the gripping surface 32, is common during use. The insert 30 or the gripping surface 32 can become damaged by wear and tear or even broken off due to the abrasive forces, being transmitted to the inserts via the cutter bits 22. Even worse, the forces occasionally become constant enough to fatigue, or large enough to shear, the cutter bit 22, the insert 30 and/or the gripping surfaces 32, causing the mining or milling machine to be stopped for considerable lengths of time for repair and replacement of the damaged components.

FIG. 6 illustrates a damaged insert 70 having a damaged gripping surface 72. In one embodiment, the damaged insert 70 can be removed with the following steps. It can be appreciated by one of ordinary skill in the art that undamaged inserts may be removed with similar steps. The damaged insert 70 has the same limitations and equivalents as the insert 30 described herein. The damaged insert 70 is shown in FIG. 6 threadably engaging with the base portion 20 that is attached to the portion 8 of the drum of the mining or milling machine, without the cutter bit. The damaged insert 70 can be removed with the following steps. The shafted fastener 62 can be inserted through the pathway 60 of the damaged insert 70 along the longitudinal axis Z and into the end opening 50 to extend past the end opening 50. The periphery surfaces of the fastener 56 can also be securably engaged within the end opening 50 of the damaged insert 70 along the longitudinal axis Z. The fastener 56 can slide into the end opening 50, where the walls of the end opening 50 prevent the fastener 56 from substantially rotating within the end opening 50. Another step can include threadably engaging the shafted fastener 62 with the fastener 56. Once the shafted fastener 62 is securably engaged with the fastener 56, an appropriate tool (not shown) can be securably engaged with the head 61 of the shafted fastener 62. The shafted fastener 62 can then be rotated with sufficient force in the appropriate direction. For example, the appropriate tool can be a wrench or ratchet socket wrench. The rotation of the appropriate tool can cause the rotation of the damaged insert 70 in the same direction to disengage the threaded portion 38 of the damaged insert 70 from the threaded portion of the opening 26 of the base portion 20. The damaged insert 70 can then be removed from the base portion 20.

Similarly, when the damaged insert includes a polygonal opening, an appropriate tool can be inserted to securably engage with the polygonal opening through. The tool can be inserted through the interior bore from the top or from the bottom of the insert. Preferably, the appropriate tool has a polygonal-shape substantially similar to the cross-section of the polygonal opening. For example, the appropriate tool can be an Allen wrench if the polygonal opening is hexagonal. Once the appropriate tool is securably engaged with the polygonal opening, the appropriate tool can be rotated with sufficient force in an appropriate direction. The rotation of the appropriate tool can cause the rotation of the insert in the same direction to disengage the threaded portion of the insert from the threaded portion of the base portion opening. The insert can then be removed from the base portion.

In accordance with the provisions of the patent statutes, the present invention has been described in what is considered to represent its preferred embodiment. However, it should be noted that the invention can be practiced otherwise than as specifically illustrated and described.

The invention claimed is:

1. A cutter bit insert system for use on a portion of a milling or mining drum, adapted to be rotated in a cutting direction about a cylindrical axis defined by said drum, the system comprising:

a base portion adapted to be mounted to a portion of a drum and defining a tapped opening; and a cutter bit insert having a first end and a second end and defining an interior bore to receive at least one cutter bit, a threaded portion threadably engageable with the tapped opening of the base portion, the interior bore having a first end positioned proximate the first end of the insert and a second end terminated at a portion between the first and second ends of the insert, and an opening extending from the second end of the insert to the second end of the interior bore, to receive an apparatus engageable with said opening for rotation of the insert relative to the base portion.

2. The system of claim 1, wherein the opening has a cross-sectional area greater than a cross-sectional area of the interior bore.

3. The system of claim 1, wherein the opening of the insert has a shape with at least one of a planar surface and a rounded corner.

4. The system of claim 3, wherein the shape of the opening of the insert further comprises four planar surfaces interconnected by rounded corners.

5. The system of claim 1, wherein the interior bore has a circular cross-section.

6. The system of claim 1, wherein the opening of the insert has a multi-sided shape selected from a group consisting of: rectangular, pentagonal, hexagonal, octagonal, and spline.

7. The system of claim 6, wherein the opening of the insert has a cross-sectional area less than a cross-sectional area of the interior bore.

8. The system of claim 1, wherein the opening of the insert comprises a first portion and a second portion, the first portion having a hexagonal shape, the second portion having a shape with four planar surfaces interconnected by rounded corners.

9. A system for removing an insert from a base portion mounted on a portion of a milling or mining drum, the base portion defining a tapped opening, and the insert having a first and second end and defining an interior bore to receive at least one cutter bit, a threaded portion threadably engageable with the tapped opening of the base portion, and an opening extending from the second end of the insert to the second end of the interior bore, the system comprising an apparatus to engage with said opening of the insert, whereby in response to rotation of the apparatus that is engaged with the opening of the insert the insert is rotatably removed from the base portion when the insert and the base portion are threadably engaged.

10. The system of claim 9, wherein the opening of the insert has a shape with at least one of a planar surface, and the apparatus comprises a body with a substantially similar shape as said opening of the insert and a threaded portion.

11. The system of claim 10 further comprising a shafted fastener having a threaded portion threadably engageable with the threaded portion of the apparatus, wherein the interior bore and the opening of the insert are in communication to define a pathway sized to receive said shafted fastener.

12. The system of claim 11, wherein the opening of the insert has a hexagonal shape, and the apparatus comprises a tool having a similar shape as said opening.

13. A method of removing an insert from a base portion mounted on a portion of a drum for use with a mining or milling machine, the base portion having a tapped opening, the method comprising the steps of:

providing an insert threadably engaged with the tapped opening of said base portion, the insert having a first and second end and defining an interior bore to receive at least one cutter bit, a threaded portion threadably engageable with the tapped opening of said base portion, and an opening extending from the second end of the insert to the second end of the interior bore;

securably engaging an apparatus with the opening of the insert, the apparatus to be engageable with said opening to facilitate the rotation of the insert relative to the base portion;

rotating the apparatus with sufficient force to disengage the threaded portion of the insert from the tapped opening of said base portion to remove the insert from the base portion.

14. The method of claim 13, wherein the apparatus is a fastener being configured to engage with the opening and having a threaded portion, the method further comprising the step of securably engaging a shafted fastener with the fastener, the shafted fastener having a threaded portion threadably engageable with the threaded portion of the fastener.

15. The method of claim 14, wherein the threaded portions of the shafted fastener and the fastener are threaded oppositely to the threaded portion of the insert and the tapped opening of said base portion.

16. The method of claim 14 further comprising the step of inserting the shafted fastener within a washer, the washer having a cross-sectional area greater than a cross-sectional area of the interior bore.

17. The method of claim 14, wherein the shape of the opening further comprises four planar surfaces interconnected by rounded corners.

18. The method of claim 14, wherein the fastener has a portion extending past the second end of the insert, the method further comprising the step of securably engaging said portion during the rotation step.

19. The method of claim 13, wherein first end of the insert includes an entry opening sized to receive a flange of the cutter bit, the entry opening having a first end with a circular cross-sectional area greater than a circular cross-sectional area of a second end of the entry opening, and the interior bore has a circular cross-sectional area substantially the same as the cross-sectional area of the entry opening second end.

20. The method of claim 13, wherein the opening has a multi-sided shape selected from a group consisting of: rectangular, pentagonal, hexagonal, octagonal, and spline, and the apparatus has a body similarly shaped as the opening to engage frictionally with said opening.

* * * * *